US010687570B2

(12) United States Patent
Strange

(10) Patent No.: US 10,687,570 B2
(45) Date of Patent: Jun. 23, 2020

(54) CAPABLE CLOTHING PANTS

(71) Applicant: Temeka T. Strange, Naperville, IL (US)

(72) Inventor: Temeka T. Strange, Naperville, IL (US)

( * ) Notice: Subject to any disclaimer, the term of this patent is extended or adjusted under 35 U.S.C. 154(b) by 181 days.

(21) Appl. No.: 15/484,102

(22) Filed: Apr. 10, 2017

(65) Prior Publication Data

US 2018/0289085 A1 Oct. 11, 2018

(51) Int. Cl.

| | |
|---|---|
| ***A41D 13/00*** | (2006.01) |
| ***A41D 13/12*** | (2006.01) |
| ***A41F 9/00*** | (2006.01) |
| ***A41D 1/06*** | (2006.01) |
| *A41D 27/20* | (2006.01) |
| *A44B 19/26* | (2006.01) |

(52) U.S. Cl.

CPC ..... *A41D 13/1254* (2013.01); *A41D 1/06* (2013.01); *A41F 9/007* (2013.01); *A41D 27/205* (2013.01); *A41D 2300/32* (2013.01); *A41D 2300/322* (2013.01); *A41F 9/00* (2013.01); *A44B 19/262* (2013.01)

(58) Field of Classification Search

CPC .... A41D 12/1254; A41D 12/129; A41D 1/06; A41D 27/205; A41D 2300/32

See application file for complete search history.

(56) References Cited

U.S. PATENT DOCUMENTS

| | | | | | |
|---|---|---|---|---|---|
| 2,568,083 | A | | 9/1951 | Mitchell | |
| 2,923,009 | A | * | 2/1960 | Cookman | A41D 1/06 2/218 |
| 3,246,342 | A | * | 4/1966 | Pagano | A41D 1/06 2/227 |
| 3,949,427 | A | | 4/1976 | Sampey | |
| 3,994,026 | A | * | 11/1976 | Sampey | A41D 13/02 2/79 |
| 4,145,763 | A | * | 3/1979 | Abrams | A41B 9/007 128/DIG. 15 |
| 4,258,440 | A | * | 3/1981 | McGowan | A41D 13/1236 2/114 |
| 4,447,911 | A | | 5/1984 | Marcellaro | |
| 4,533,355 | A | * | 8/1985 | Fair | A61F 5/445 2/238 |
| 4,651,353 | A | | 3/1987 | Walden | |

(Continued)

OTHER PUBLICATIONS

Adaptive Fleece Sweat Pants with two full length side zippers, posted at www.adaptiveclothingshowroom.com, posting date by Sep. 25, 2014, [online], [site visited Jul. 17, 2018]. Available from Internet, URL: http://adaptiveclothingshowroom.com/adaptive-full-length-side-zipper-fleece-pants/ (Year: 2014).

(Continued)

*Primary Examiner* — Richale L Quinn
(74) *Attorney, Agent, or Firm* — Frost Brown Todd LLC

(57) ABSTRACT

A functional pair of pants for men and women with spinal injuries that allow improved access to the pelvic region without removal of the pants. A moveable front flap is formed on the pants via side zippers and a top fastening means that extends across the front of the waistband of the pants. Even individuals with limited fine motor skills can manipulate the corded zipper pulls to allow access for changing an ostomy bag, diaper, or catheterization.

14 Claims, 4 Drawing Sheets

(56) References Cited

U.S. PATENT DOCUMENTS 5,289,590 A * 3/1994 Larson ..... A41D 13/0007 2/227
5,634,215 A 6/1997 DeBaene
5,706,523 A * 1/1998 Witzel ..... A41D 13/0506 2/227
5,799,328 A * 9/1998 Harlem ..... A41D 13/1236 2/114
5,822,793 A 10/1998 Tokura et al.
5,822,802 A 10/1998 Chou
5,926,851 A * 7/1999 Kovalik ..... A41D 1/06 2/114
6,101,634 A * 8/2000 Martinez ..... A61G 7/1023 128/845
6,108,819 A 8/2000 DeBaene et al.
6,327,714 B1 * 12/2001 Koerner ..... A41F 9/00 2/227
6,954,946 B2 * 10/2005 Goldfarb ..... A41F 9/002 2/338
D612,580 S 3/2010 Hall et al.
D613,038 S 4/2010 Viola et al.
D622,935 S * 9/2010 Jackson ..... D2/742
8,087,098 B2 * 1/2012 Kimberly ..... A41B 9/001 2/227
8,402,565 B1 3/2013 Penner
8,464,365 B1 * 6/2013 Nunn ..... A41D 1/08 2/227
8,505,118 B2 8/2013 Bang
8,671,529 B2 * 3/2014 Mima ..... B60N 2/5825 24/432
D739,120 S 8/2015 Young
9,247,774 B2 * 2/2016 Davis ..... A41D 13/02
9,277,774 B2 * 3/2016 Gosse ..... A41D 1/082
10,123,573 B2 * 11/2018 Hays ..... A41C 1/08
D839,542 S 2/2019 Strange
2006/0010571 A1 * 1/2006 Oakley ..... A41D 1/062 2/227
2012/0005797 A1 1/2012 Cotsoglou et al.
2012/0174285 A1 * 7/2012 Williams ..... A41B 13/00 2/80
2013/0007939 A1 1/2013 Martinez
2014/0230130 A1 * 8/2014 Edwards ..... A41D 1/065 2/227
2016/0219943 A1 8/2016 Hoiles
2016/0360806 A1 12/2016 Thomas
2017/0311662 A1 11/2017 Pina et al.
2018/0168250 A1 6/2018 Ly

OTHER PUBLICATIONS

Men's Adaptive Side Zipper Fleece Pants, posted at www.adaptiveclothingshowroom.com, posting date by Jun. 18, 2014, [online], [site visited Jul. 17, 2018]. Available from Internet, URL: http://adaptiveclothingshowroom.com/mens-adaptive-side-zipper-fleece-pants/ (Year: 2014).

Inner Opening Jersey Dropfront Wheelchair Trousers, posted at www.able2wear.co.uk, posting date not given, [onilne], [site visited Jul. 17, 2018]. Available from Internet, URL: https://www.able2wearco.uk/inner-opening-jersey-dropfront-wheelchair-trousers.html (Year: 2018).

IZ Adaptive pants, posted at www.mic.com, posting date not given, [online], [site visited Jul. 17, 2018]. Available from Internet, URL: https://www.mic.com/articles/132453/these-are-the-designers-working-hard-to-make-stylish-clothes-for-wheelchair-users (Year: 2016).

* cited by examiner

CAPABLE CLOTHING PANTS

CROSS REFERENCE TO RELATED APPLICATIONS

This application claims priority to and the benefit of the concurrently filed U.S. Design Patent Application to the same inventor named above, the entire contents of which are incorporated by reference in their entirety as if fully set forth herein.

STATEMENT REGARDING FEDERALLY SPONSORED RESEARCH OR DEVELOPMENT

None.

TECHNICAL FIELD

This disclosure relates to articles of clothing for physically challenged individuals, and more specifically to performance wear for physically challenged individuals.

BACKGROUND

There are an estimated 10,000 to 12,000 spinal cord injuries each year in the United States. Different spinal cord injuries leave the individual with varying degrees of mobility and fine motor skills with resulting ranges of ability to handle everyday tasks for themselves. A common thread can however be found across the broad spectrum of injuries, in that most spinal care patients desire to feel and act as "normal" as possible, and appreciate any tools and resources that make their lives easier and more enjoyable.

Traditionally caretakers of more severe spinal cord injury patients face a long grueling process each day with getting the patient dressed because of the constant turning and lifting required to get each piece of clothing under and around them. Once the patient is dressed, the patient is turned and lifted again to place a net under them in order to hook them up to a lifting machine that lifts them from their bed and moves them over to their chair. This dressing and lifting process is so time consuming, that by the time they are seated in their chair, they usually need to use the bathroom again.

This causes the process to have to be reversed, starting with lifting the patient out of the chair back onto the bed, undressing them and then straight catheterizing them.

While various garment configurations have been proposed for use by patients requiring access to their pelvic region, there remains a need for a convenient and useful garment to meet the needs of these patients.

In U.S. Patent Application Publication No. US 2014/0230130, Edwards discloses a garment with moveable and removable panels. The zippered panels may be placed to cover the front/crotch area of the pants and unzipped to provide access to the interiors of the garment. Edwards also discloses that the panels may be trapezoidal in shape or various other shapes as well, such that when the panel is unzipped and in the open configuration, the waistband defines the upper limits of the opening and the edges of the pants adjacent to the zippers define the two sides.

In U.S. Pat. No. 5,926,851, issued to Kovalik, a garment for use by the elderly, handicapped and infirmed is disclosed. The garment has a flap provided in the front torso portion to allow easy donning and removal of the garment. Kovalik also discloses that the flap extends from the waistband down to the crotch area of the garment and includes attachment means for securing the flap including Velcro strips along the length of the flap and buttons at the top to secure the flap to the waistband.

In U.S. Patent Application Publication No. US2013/0007939 Martinez discloses a set of clothing for use by handicapped children and adults that have been adapted to be fashionable and comfortable as well. Martinez discloses a pair of pants having a pair of zippers along the entire vertical length of the pants for providing relatively easy access to the patient's legs and side while making it relatively easy to put-on and take off the pants. Martinez also discloses that the pants are made for both men and women and can be configured as short pants or other suitable pants as well.

A number of other garments for allowing access to the pelvic area have been proposed. However, there continues to be a need for a practical garment for convenient use by patients requiring regular access to the pelvic area which addresses the various needs of the patients and solves the problems associated with conventional garments.

SUMMARY

The present article of clothing provides a spinal cord injury patient with the ability to overcome the challenges provided by wearing traditional pants without sacrificing the style and function of traditional clothes such as blue jean pants.

In one exemplary embodiment, a pair of traditional looking jean pants that incorporates a lowered front waistband for improved comfort across the stomach area when seated, as well as a raised rear waistband with elastic segments for improved coverage and fitment is disclosed.

In various embodiments, the pants include zippers along both sides of the front of the pants to allow the front panel or flap to be lowered away from the front waistband for easy access to the pelvic region. The zippers have a corded zipper pull with the looped cord being of sufficient circumference to allow a finger or thumb to be inserted within the loop to pull the zipper up or down. The top of the front flap is secured to the lowered front waistband of the pants with interior hook and loop fastening strips such that the pants appear to function like traditional pants. The inward facing side of the front flap contains the loop strip for connection to the outward facing hook strip that is attached to the outside of the waistband. The hook strip is placed on the outside of the waistband away from the wearer so the wearer is not irritated or scratched by the hooks.

The men's and women's version of the pants are distinguished mainly by the additional zipper length provided for women to access their pelvic region. The zippers on the men's pants extend approximately 8 to 10 inches down the length of the pants, whereas the women's pants zipper extends down approximately 14 to 16 inches down each side of the pants.

The jean pants are preferably an 8.6 oz. super stretch denim fabric, comprised of 98% cotton and 2% polyurethane. This extra stretchy denim fabric has about 25% stretch for comfort and better fit.

In certain embodiments the front pockets are operable pockets rather than nonfunctional threadwork made to resemble operable pockets.

Optionally, a back pocket, or a lower side pocket may be provided for holding a cell phone or other items.

In alternative embodiments, the pants may be made of a variety of fabrics to simulate the appearance of hospital pants, dress pants or jogging pants.

Certain advantages of the capable pants include wearer comfort features like plastic zippers to protect the wearer's skin from breakdown and irritations caused by metal zippers, and elastic bands within the jean portions of the waistband for improved fit without the need for a belt. The dual horizontal elastic bands of the rear waistband are sewn together to reinforce each other on both the left and right sides of the rear waistband and provide improved durability, coverage and comfort.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

BRIEF DESCRIPTION OF DRAWINGS

The present embodiments are illustrated by way of the figures of the accompanying drawings, which may not necessarily be to scale, in which like references indicate similar elements, and in which.

DETAILED DESCRIPTION OF DRAWINGS

Figure 1:
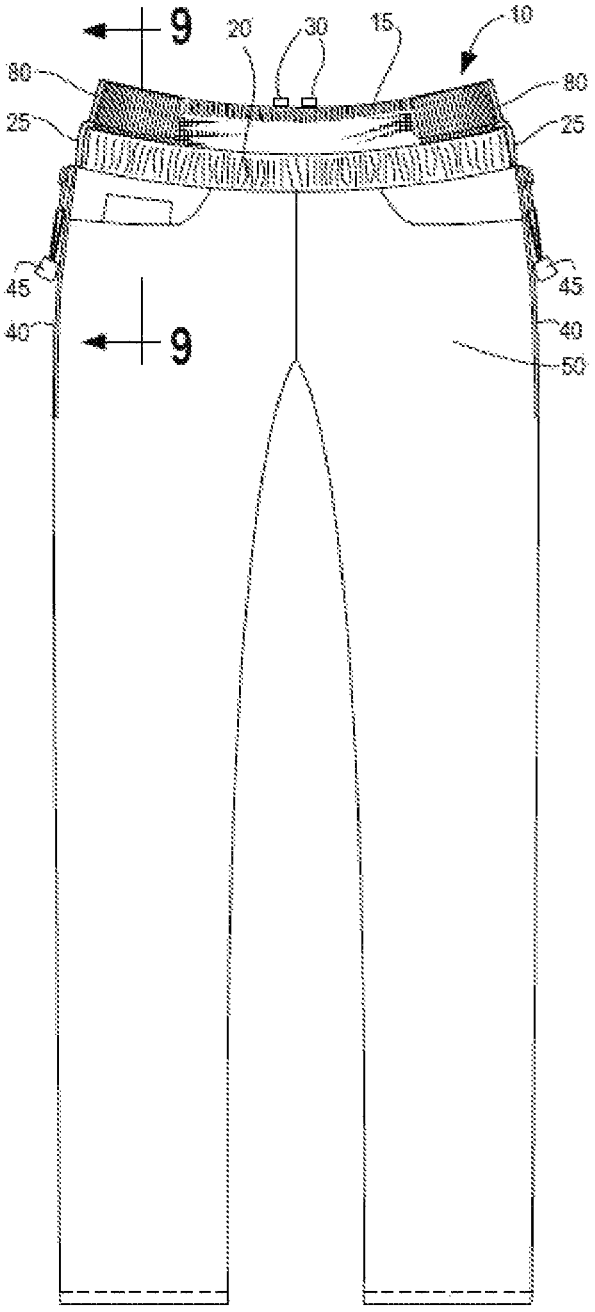
FIG. 1 is a front perspective view of the men's pant.

While these pants are susceptible to embodiments in many different forms, there are shown in the drawings, and will herein be described in detail, preferred embodiments of the invention with the understanding that the present disclosure is to be considered an exemplification of the principles of the invention and is not intended to limit the broad aspect of the invention to the embodiments illustrated.

The present disclosure provides a pair of pants 10 capable of providing improved access to the pelvic region of a spinal injury patient. In general, the pants include a lowered front waist band 20 for increased wearer comfort when in a seated position, a higher rear waist band 15 for additional coverage, and corded zipper pulls 45 for maneuvering the zippers 40 up and down even with limited fine motor skills.

Figure 2:
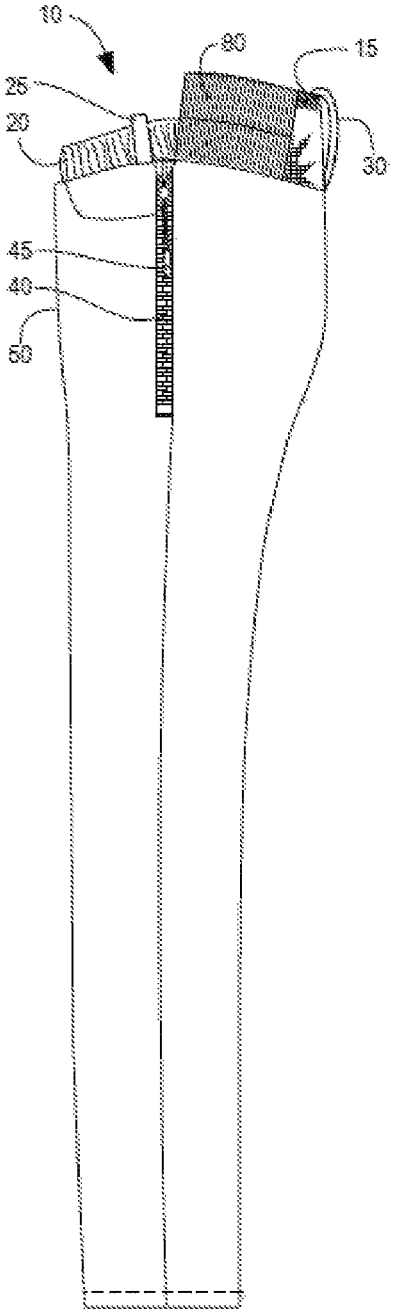
FIG. 2 is a left side perspective view of the men's pant.
Figure 11:
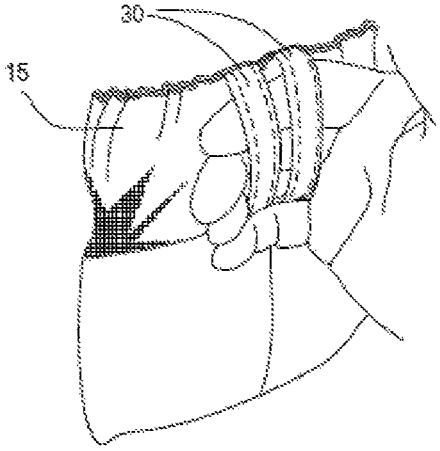
FIG. 11 shows the rear lift loops engaged for lifting the patient.

The side lift loops 25 are shown in FIG. 2 along with the larger rear lift loops 30 for lifting and transferring a patient from a chair to their bed. Both the side lift loops 25 and the rear lift loops 30 are attached to and secured within the seam of the pants to allow the rear lift loops 30 to be used in lifting and moving the patient as seen in FIG. 11.

Figure 3:
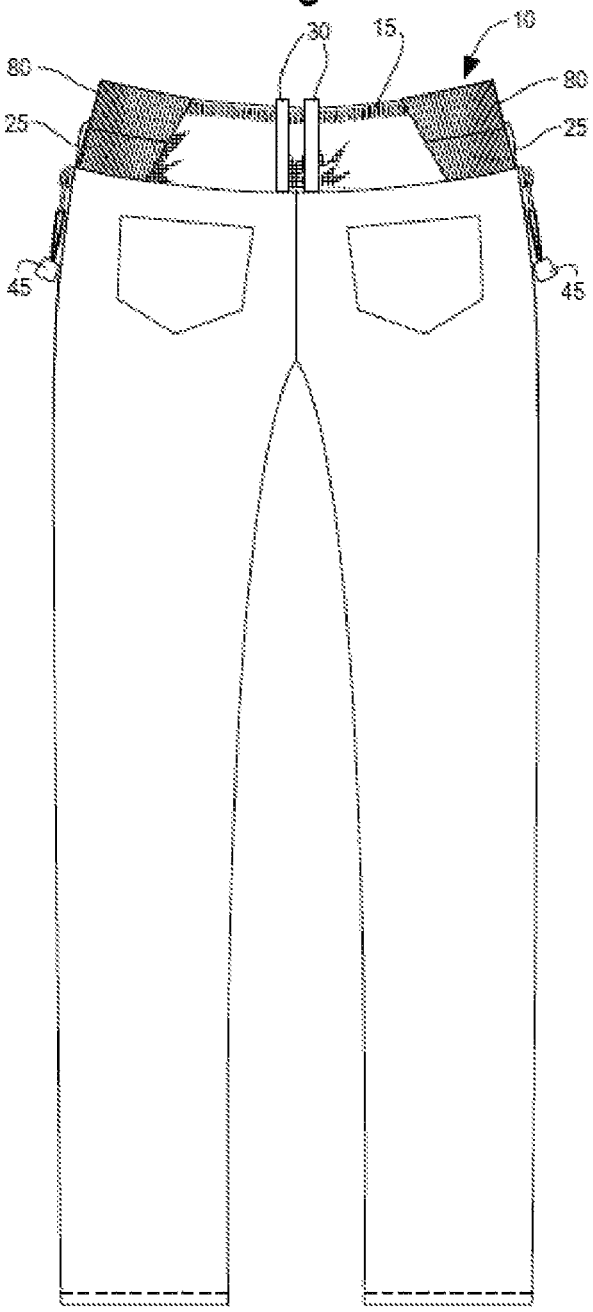
FIG. 3 is a rear perspective view of the men's pant.

FIG. 3 shows the rear of the men's capable pants 10 along with the dual elastic bands 80 that are stitched together to provide flexibility, comfort and support for the pants while being worn. The corded zipper pull 45 provides a loop hole large enough for insertion of a finger or thumb to move the zipper pull up and down.

Figure 4:
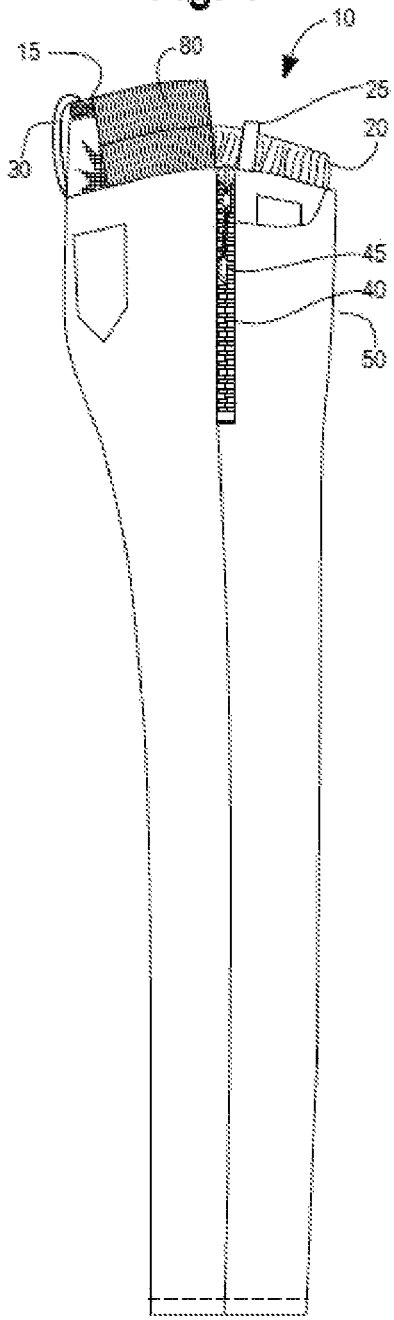
FIG. 4 is a right side perspective view of the men's pant.

FIG. 4 shows the rear lift loops 30, and side lift loops 25 that are securely attached to the inside of the pants at the seam to allow the lift loops to be used in moving the patient.

Figure 5:
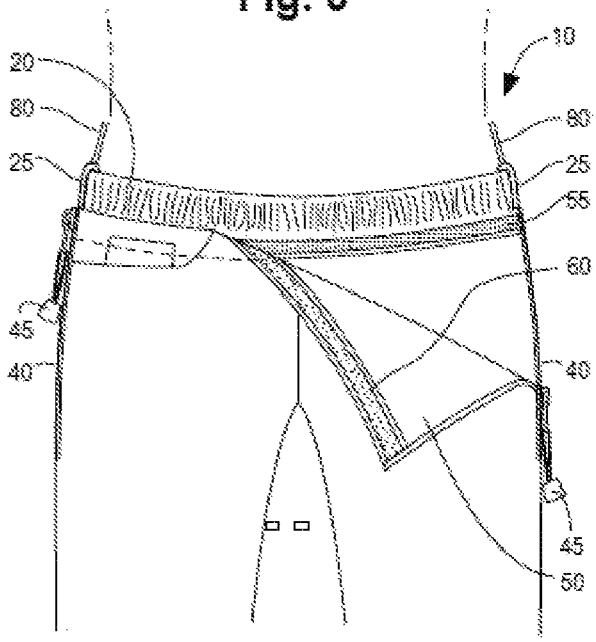
FIG. 5 is a front perspective view of the men's pant with one side unzipped.

FIG. 5 shows the left zipper 40 in the unzipped position with the front pants flap 50 hanging down on the left side. The hook fastener 55 of the fastener faces away from the body, while the loop side fastener 60 faces the body. The hook fastener 55 on the outside of the waistband 20 meets the loop side fastener 60 on the inside of the front pants flap 50 below the top of the flap 50, such that the hook and loop fastener strips are concealed when the front pants flap 50 is zipped up, as seen on the right side.

Figure 6:
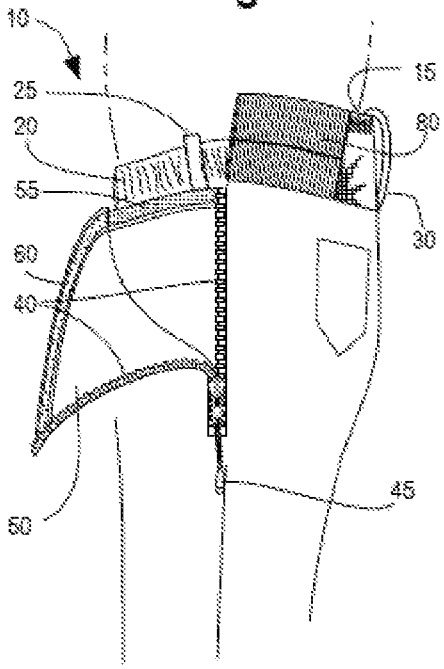
FIG. 6 is a side perspective view of the unzipped side of the men's pant.

FIG. 6 shows the unzipped left side of the front pants flap 50 from the side view along with the zipper pull 45 in the fully opened position.

Figure 7:
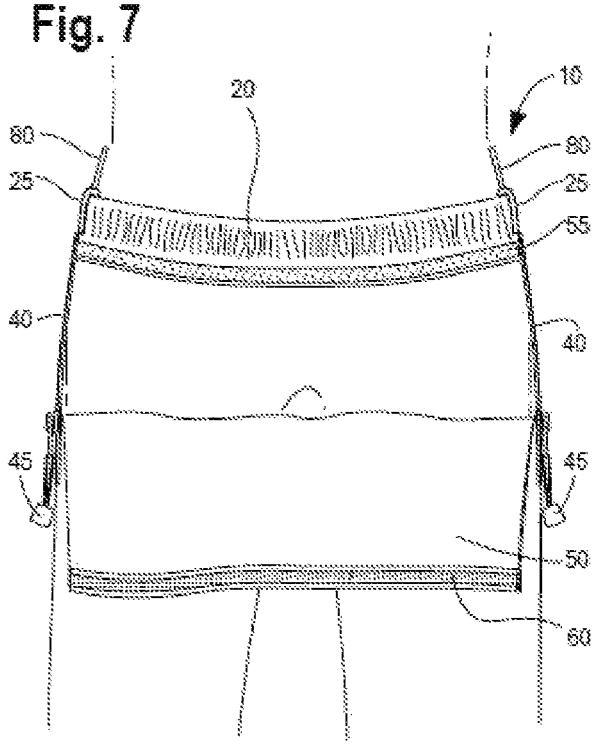
FIG. 7 is a front perspective of the unzipped men's pant.

FIG. 7 shows a front view of the fully unzipped front pants flap 50, along with the hook fastener 55 for securing the front pants flap 50 to the stationary front waist band 20 when the zippers 40 are zipped up.

Figure 8:
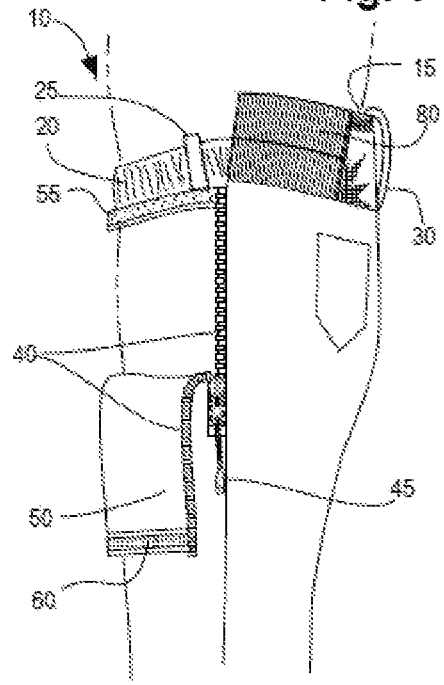
FIG. 8 is a side perspective view of the unzipped men's pant.

FIG. 8 shows a left side view of the fully unzipped front pants flap 50, along with the side lift loops 25 and the rear lift loops 30.

Figure 9:
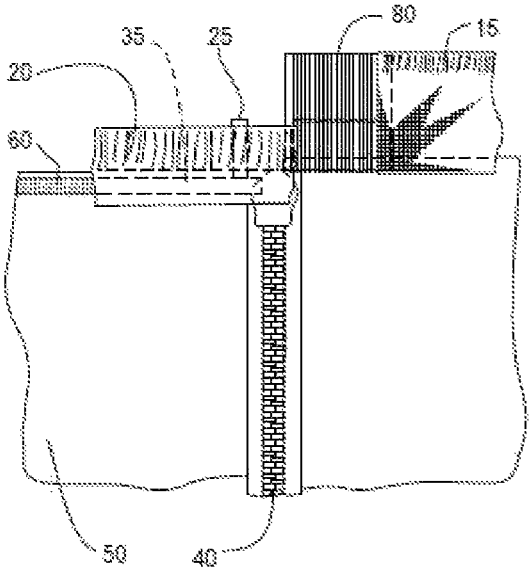
FIG. 9 is a cross section view of FIG. 1 at 9-9.

FIG. 9 shows inside of the pants at the cross section 9-9 of FIG. 1 with the loop side fastener 60 of the front pant flap 50 securing the flap to the waist band 20 by the hook fastener 55.

Figure 10:
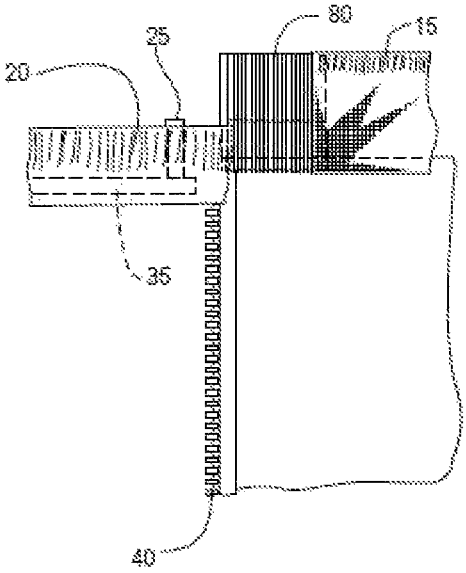
FIG. 10 shows a cross section view of the unzipped pants.

FIG. 10 shows the cross section view with the flap unzipped, such that the front waistband 20 is shown without the front pants flap 50.

FIG. 11 shows the rear lift loops 30 being engaged by a caregiver to lift the patient.

CONCLUSION, RAMIFICATIONS AND SCOPE

Accordingly, it is shown that the capable pants provide improved comfort and usability to spinal injury patients who desire to wear pants or jeans rather than sweat pants or jogging pants. Patients can use the corded zipper pulls to lower and raise the front flap of the capable pants for easy access to their pelvic area even with limited fine motor skills. The elastic of the lower front waistband provides support and secures the fit of the pants around the waist whether the front flap is zipped up and closed or unzipped and hanging down. The additional room for the stomach area provided by the lower front waistband is helpful for patients who spend a great deal of time in a seated position. The higher rear waistband with elastic inserts provides improved back coverage as well as a snug and secure fit.

In addition, capable pants provide additional advantages in that they provide caregivers sturdy lift loops on the sides and rear of the pants to assist with lifting the patients, provide caregivers easy access to the pelvic area of the patient for treatment or hygienic care, and provide diaper wearers in treatment centers and long term care facilities with the ability to change their diapers without removing their pants.

A number of illustrative embodiments have been described. Nevertheless, it will be understood that various modifications may be made without departing from the spirit and scope of the various embodiments presented herein. For example, the addition of a cell phone pocket along the lower leg portion of the pants was noted by many patients as being helpful and useful. Additionally capable pants can be adjusted in size and zipper length to accommodate smaller individuals including children. Accordingly, the scope of the embodiments should be determined by the appended claims and their legal equivalents, rather than by the examples given.

What is claimed is:

1. A pair of pants comprising a waistband, a front pants flap, and one or more lift loops, wherein the front pants flap comprises a first fastener extending along a width of a top portion of the front pants flap, wherein the waistband comprises a second fastener extending along a width of the waistband adjacent to the front pants flap, wherein the first fastener and the second fastener are selectively coupled with each other such that the front pants flap is positioned in a raised configuration when the first fastener is coupled with the second fastener and the front pants flap is positioned in a lowered configuration when the first fastener is removed from the second fastener to provide access to the pelvic area of the patient without removing the pants, wherein the pants further comprise a pair of first lift loops and a pair of second lift loops for lifting a user, wherein each lift loop of the pair of first lift loops is positioned about a side portion of the waistband and each lift loop of the pair of second lift loops is positioned about a back portion of the waistband adjacent to each other such that a finger may be positioned simultaneously through both lift loops of the pair of second lift loops, wherein each lift loop of the pair of first and second lift loops are attached to and secured within a seam of the waistband.

2. The pants of claim 1 wherein the front pants flap comprises a vertical zipper along each side of the pants.

3. The pants of claim 2 further comprising corded zipper pulls attached to the zippers to allow the insertion of a finger or thumb into the corded pull for vertical manipulation of the zipper.

4. The pants of claim 2 wherein the zippers are plastic.

5. The pants of claim 2 further comprising a cell phone or storage pocket below the zipper.

6. The pants of claim 2, wherein the zippers are comprised of a plastic material for wearer comfort.

7. The pants of claim 2, wherein the waistband comprises an integral elastic band extending continuously about a top portion of the pants, wherein a top edge of each of the vertical zippers is positioned below a bottom edge of the integral elastic band of the waistband such that the waistband remains intact when the zippers are lowered.

8. The pants of claim 2, wherein the vertical zipper along each side of the pants extends along only a portion of a length of the pants.

9. The pants of claim 1, wherein the waistband further comprises a lowered front waist band, and a raised rear waistband.

10. The pants of claim 9, wherein the raised rear waistband further comprises a first horizontal elastic band and a second horizontal elastic band positioned above the first horizontal elastic band for improved support of the pants.

11. The pants of claim 1, wherein the first and second fasteners comprise hook and loop fasteners.

12. The pants of claim 1, wherein the waistband comprises an elastic material extending continuously about a top portion of the pants.

13. The pants of claim 1, wherein the pants comprise a stretch denim fabric.

14. The pants of claim 1, wherein the pair of second lift loops has a longer length than the pair of first lift loops.

* * * * *